US009780490B2

(12) United States Patent
Xing et al.

(10) Patent No.: US 9,780,490 B2
(45) Date of Patent: Oct. 3, 2017

(54) CABLE CONNECTOR HAVING A METAL SHELL WITH A METAL CAGE AT ITS REAR END ENCLOSED BY AN OUTER HOUSING

(71) Applicant: FOXCONN INTERCONNECT TECHNOLOGY LIMITED, Grand Cayman (KY)

(72) Inventors: Da-Wei Xing, Kunshan (CN); Yong-Wei Chen, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/169,954

(22) Filed: Jun. 1, 2016

(65) Prior Publication Data

US 2016/0352047 A1 Dec. 1, 2016

(30) Foreign Application Priority Data

Jun. 1, 2015 (CN) ..... 2015 2 0366315 U

(51) Int. Cl.

| | |
|---|---|
| ***H01R 9/03*** | (2006.01) |
| ***H01R 13/64*** | (2006.01) |
| ***H01R 13/6591*** | (2011.01) |
| *H01R 107/00* | (2006.01) |
| *H01R 13/6592* | (2011.01) |
| *H01R 24/60* | (2011.01) |

(52) U.S. Cl.

CPC ..... *H01R 13/64* (2013.01); *H01R 13/6591* (2013.01); *H01R 13/6592* (2013.01); *H01R 24/60* (2013.01); *H01R 2107/00* (2013.01)

(58) Field of Classification Search

CPC ..... H01R 9/03; H01R 13/64; H01R 13/648; H01R 13/658; H01R 13/6581; H01R 13/6591; H01R 13/629252

USPC ..... 439/607.01–607.59

See application file for complete search history.

(56) References Cited

U.S. PATENT DOCUMENTS

| | | | | |
|---|---|---|---|---|
| 6,666,719 | B1 * | 12/2003 | Kuroi | H01R 9/032 439/358 |
| 7,874,845 | B1 * | 1/2011 | Tang | H01R 13/113 439/65 |
| 8,568,159 | B2 * | 10/2013 | Noda | H01R 13/562 439/470 |
| 9,450,342 | B2 * | 9/2016 | Wu | H01R 13/6593 |

(Continued)

FOREIGN PATENT DOCUMENTS

| | | |
|---|---|---|
| CN | 204315833 U | 5/2015 |

*Primary Examiner* — Chandrika Prasad

(74) *Attorney, Agent, or Firm* — Wei Te Chung; Ming Chieh Chang

(57) ABSTRACT

A cable connector assembly includes a connector and a cable electrically connected thereto. The connector includes a metal shell, a metal cage enclosing a rear end of the metal shell, and an outer housing enclosing the metal cage therein. The connector has a front end for inserting into a mating connector and a rear end. The diametrical dimension of the front end is smaller than the diametrical dimension of the rear end. The outer housing includes a front portion extending forwardly beyond the metal cage to prevent the cable connector mistakenly inserted into an unintended receptacle connector.

17 Claims, 8 Drawing Sheets

(56) References Cited

U.S. PATENT DOCUMENTS

| | | | | |
|---|---|---|---|---|
| 9,490,579 | B2 * | 11/2016 | Little | H01R 13/642 |
| 2014/0349514 | A1 * | 11/2014 | Yang | H01R 13/6581<br>439/487 |
| 2015/0214670 | A1 * | 7/2015 | Di | H01R 13/506<br>439/607.55 |
| 2015/0288107 | A1 * | 10/2015 | Wu | H01R 13/6593<br>439/357 |
| 2016/0172791 | A1 * | 6/2016 | Fan | H01R 13/6585<br>439/607.05 |

* cited by examiner

CABLE CONNECTOR HAVING A METAL SHELL WITH A METAL CAGE AT ITS REAR END ENCLOSED BY AN OUTER HOUSING

BACKGROUND OF THE INVENTION

1. Field of the Invention

The present invention relates to a cable connector assembly, and more particularly to a cable connector assembly having an anti-mismating structure. This application relates to the copending application of Ser. No. 14/839,880 filed Aug. 28, 2015 having the same applicant and the same assignee therewith.

2. Description of Related Arts

China Patent No. 204315833 discloses a receptacle connector and a cable connector assembly. The cable connector assembly includes a connector having a metal shell defining a first receiving cavity. The receptacle connector has an outer metal shell defining a second receiving cavity. A projecting tab extends into the second receiving cavity from the outer metal shell. A positioning slit is formed in the metal shell to fit with the projecting tab to prevent a standard USB type C plug connector from mis-mating into an unintended receptacle connector. However, this anti-mismating structure may not block the cable connector assembly from mis-mating with a standard USB type C receptacle connector. Additionally, the electromagnetic interference (EMI) between an inner side of the cable connector assembly and an external environment may escape through the positioning slit.

SUMMARY OF THE INVENTION

Accordingly, an object of the present invention is to provide a cable connector assembly including a connector and a cable electrically connected thereto. The connector includes a metal shell having a front end for inserting into a receptacle connector and a rear end, a diametrical dimension of the front end being smaller than a diametrical dimension of the rear end. A metal cage encloses the rear end of the metal shell and defining a receiving chamber. An outer housing encloses the metal cage therein. A cable includes a front part received within the receiving chamber. The outer housing includes a front portion extending forwardly beyond the metal cage to prevent from mistakenly inserting into an unintended receptacle connector Other objects, advantages and novel features of the invention will become more apparent from the following detailed description when taken in conjunction with the accompanying drawings.

DETAILED DESCRIPTION OF THE PREFERRED EMBODIMENT

Figure 1:
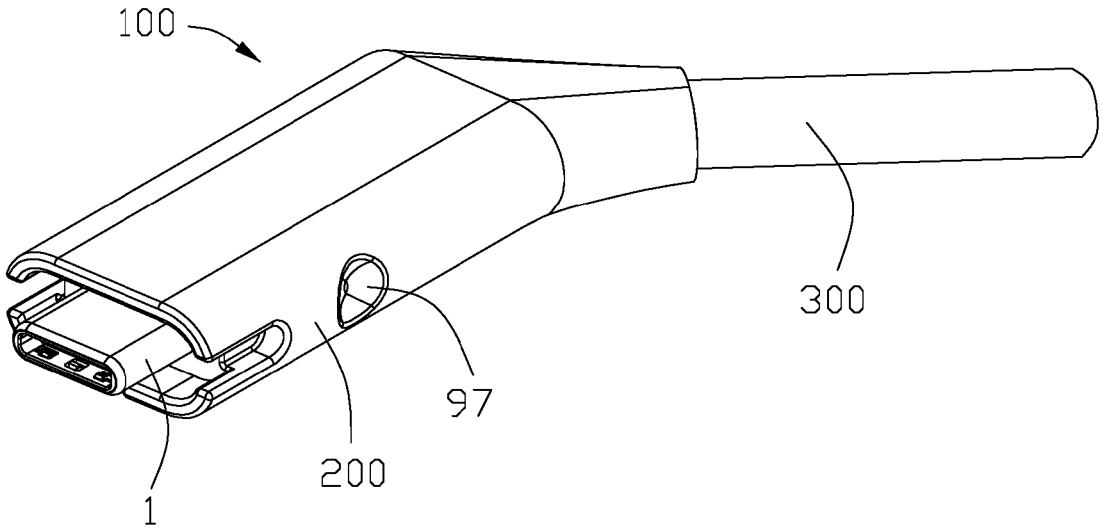
FIG. 1 is a front downward perspective view of a cable connector assembly in accordance with the present invention.
Figure 2:
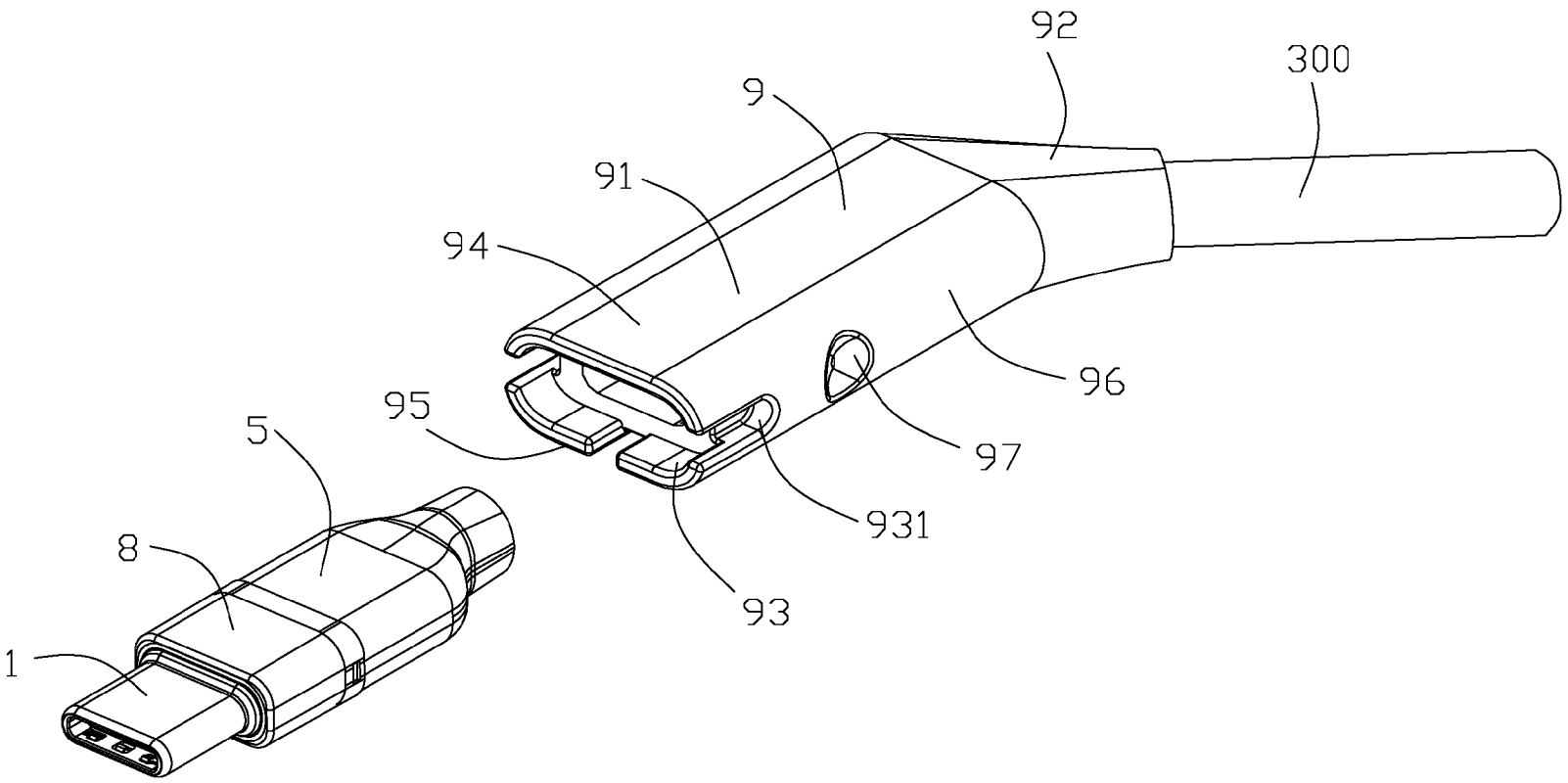
FIG. 2 is a front downward exploded view of the cable connector assembly of FIG. 1.
Figure 3:
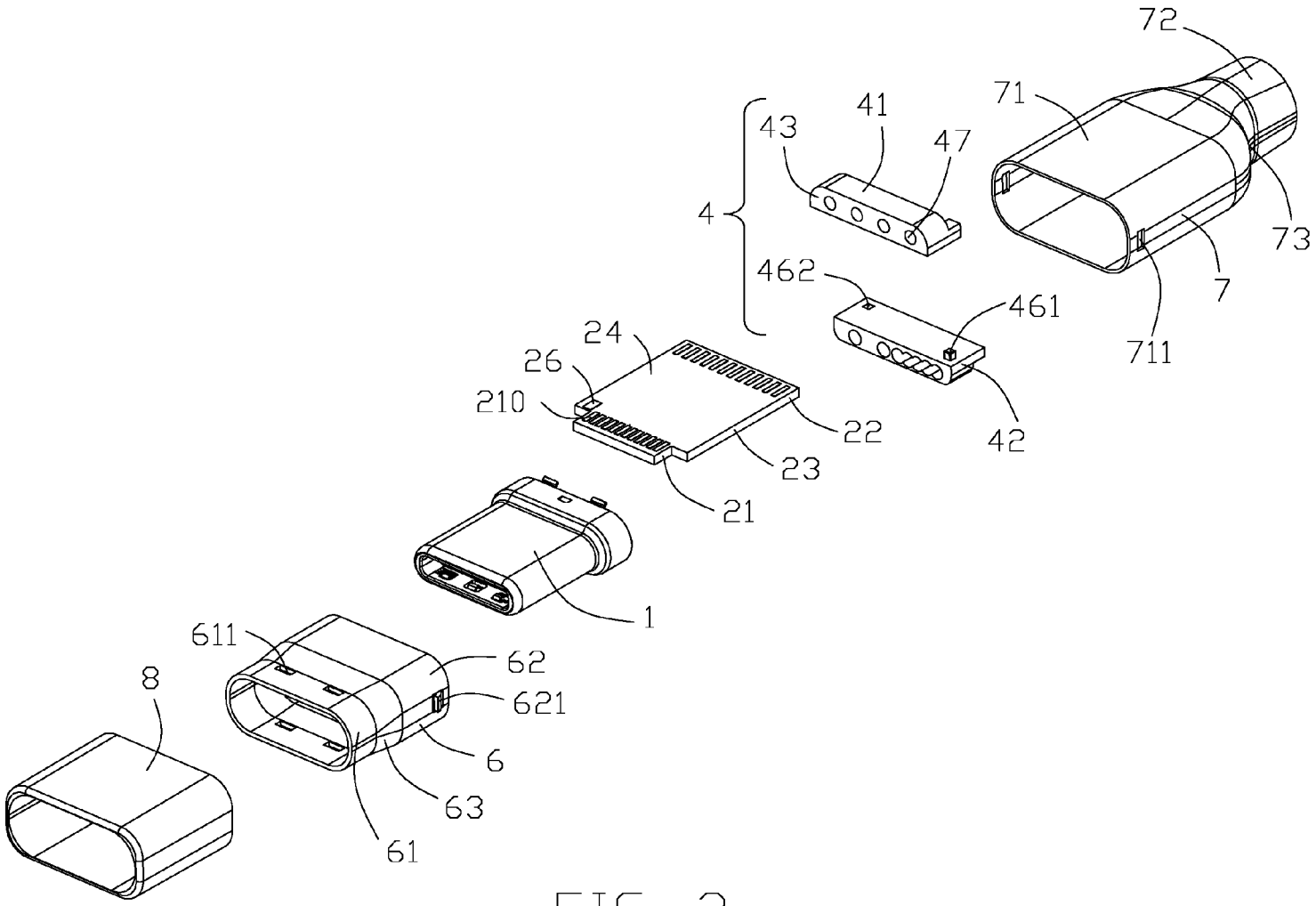
FIG. 3 is a further exploded view of the cable connector assembly of FIG. 2 with the metallic shell and the cable moved therefrom.

FIGS. 1 to 3 show a cable connector assembly 100 including an connector assembly 200 and a cable 300 electrically connected thereto. The connector assembly 200 comprises a connector 1, a printed circuit board (PCB) 2 forwardly connected to the connector 1, a spacer 4 retaining the cable 300, an metal cage 5 enclosing the PCB 2, an inner member 8 enclosing a front part of the metal cage 5, and an outer housing 9 enclosing the metal cage 5. The cable connector assembly 100 can be mated with a mating connector along two opposite directions.

Figure 5:
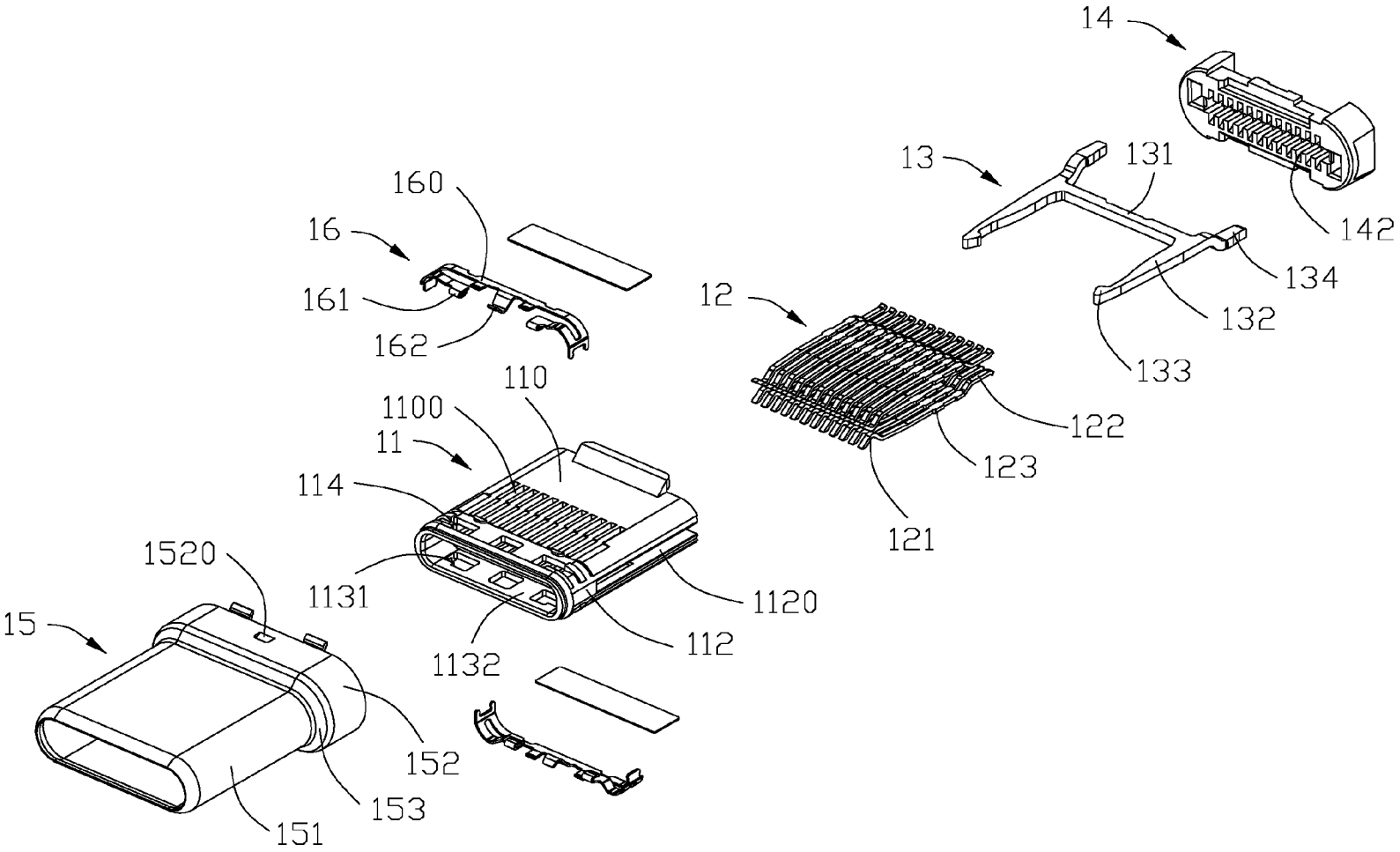
FIG. 5 is a front downward exploded view of the cable connector of FIG. 3.
Figure 6:
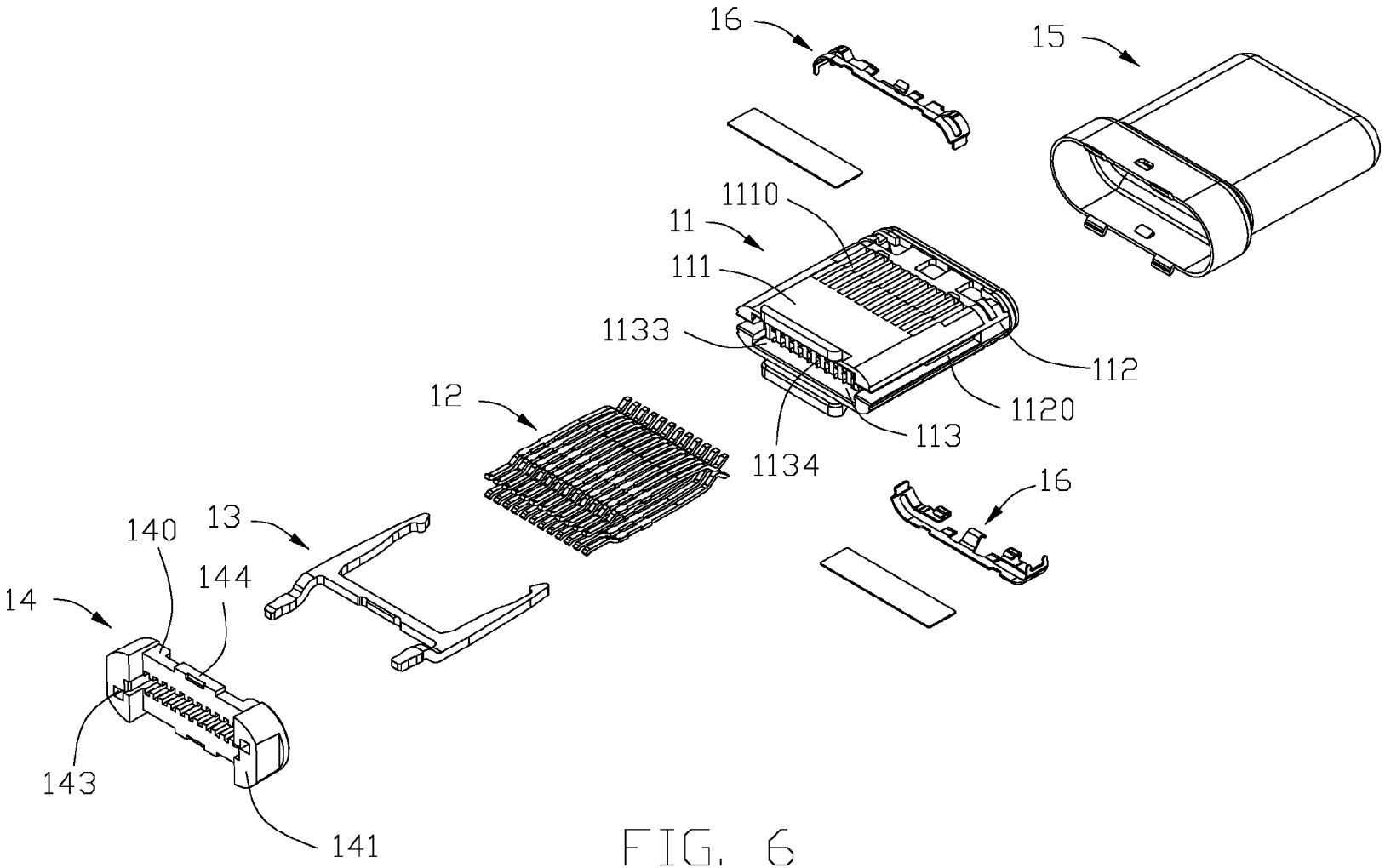
FIG. 6 is a rear upward exploded view of the cable connector of FIG. 5.
Figure 7:
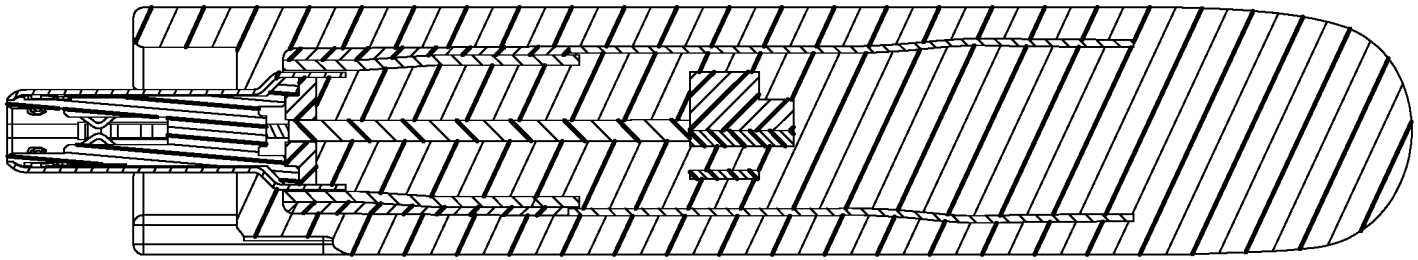
FIG. 7 is a vertical cross-section view of the cable connector of FIG. 1.
Figure 8:
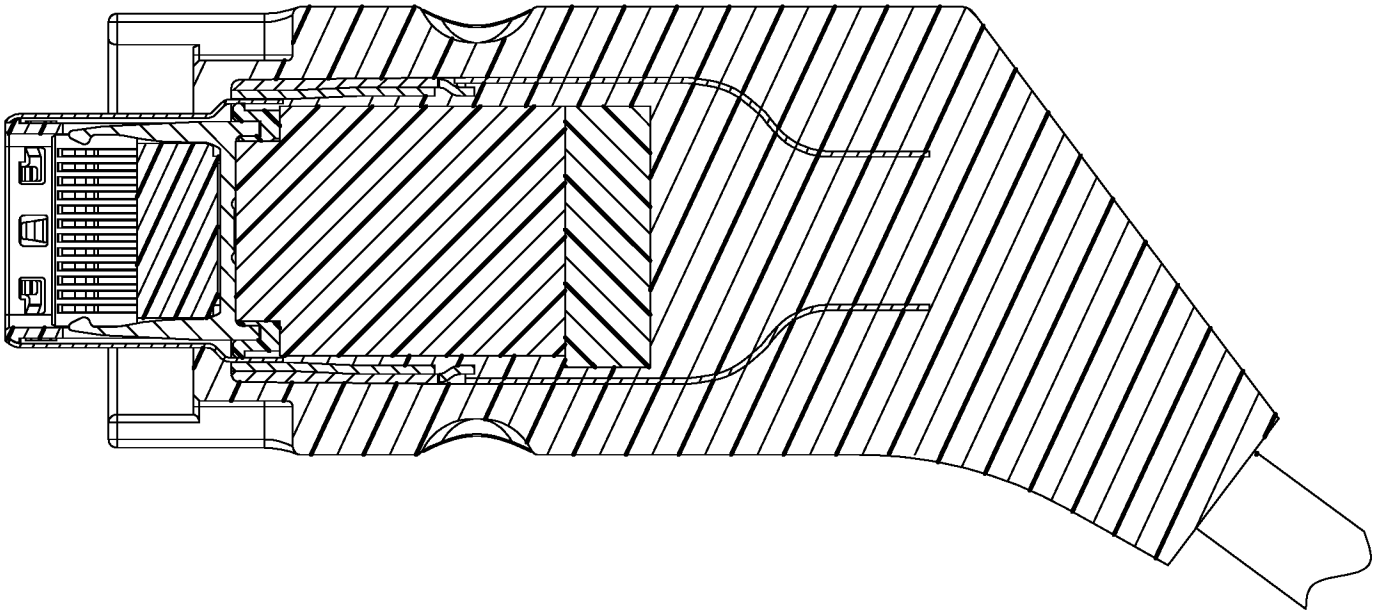
FIG. 8 is a horizontal cross-section view of the cable connector of FIG. 1.

Referring to FIGS. 5 to 6, the connector 1 comprises an insulative housing 11, a plurality of conductive terminals 12 received in the insulative housing 11 and arranged in two rows spaced apart from each other in a vertical direction, a latch 13 disposed between the two rows of conductive terminals 12 for latching with a receptacle connector, an insulative member 14 disposed behind the insulative housing 11, a metal shell 15 enclosing the insulative housing 11 and the insulative member 14, and a pair of grounding members 16 disposed on the insulative housing 11 and electrically connected to the metal shell 15.

The insulative housing 11 comprises a top wall 110, a bottom wall 111 spaced apart from and parallel with the top wall 110, a pair of side walls 112 connecting the top wall 110 and the bottom wall 111, and a receiving space 113 surround by the top, bottom, and side walls. The receiving space 113 is divided into a front portion 1132 with a front opening 1131, and a rear portion 1134 with a rear opening 1133. The top wall 110 forms a top recess 1100 in communication with the front portion 1132. The bottom wall 111 forms a bottom recess 1110 in communication with the front portion 1132. Each of the side walls 112 forms a side recess 1120 extending forwardly from a rear end of the insulative housing 11 but not through a front end of the insulative housing 11. The side recesses 1120 are communicated with the front portion 1132 and the rear portion 1134 of the receiving space 113. A plurality of mounting slots 114 are formed in the front portions of the top wall 110 and the lower wall 111.

Each of the contacts 12 comprises a front mating portion 121 extending forwardly into the front portion 1132 of the receiving space 113, a rear mating portion 122 extending rearwardly, and an intermediate mounting portion 123 retained to the insulative housing 11. The front mating portion 121 is used to be mated with the mating connector and the rear mating portion 122 is connected with the PCB 2. The front mating portions 121 of the two rows of contacts 12 are arranged in a face-to-face manner along the vertical direction.

The latch 13 comprises a base portion 131 extending along a transverse direction, a pair of latch beams 132 respectively extending forwardly from two opposite ends of the base portion 131, a latch portion 133 extending inwardly from a front end of each latch beam 132 in a face-to-face manner, and a pair of connecting tails 134 extending backwardly from two opposite ends of the base portion 131. The latch 13 is mounted into the insulative housing 11 through the rear opening 1133 of the rear portion 1134 of the receiving space 113. The latch beams 132 are received into the side recesses 1120, respectively. Each of the latch portions 133 projects into the front portion 1132 of the receiving space 113. The pair of latch portions 133 are arranged in a face-to-face manner along the transverse direction.

The insulative member 14 cooperates with the insulative housing 11 to secure the latch 13. The insulative member 14 comprises an insulative base portion 140, a pair of extending portions 141 extending rearwardly from two opposite ends of the insulative base portion 140, two rows of through holes 142 spaced apart in the vertical direction and extending through the insulative base portion 140 along a front-to-back direction, and a projected portion 144 extending upwardly. Each of the extending portions 141 defines a mounting slot 143 extending along a back-to-front direction. The insulative base portion 140 is thicker than the insulative housing 11 along the vertical direction. The insulative base portion 140 extends outwardly respect to the top wall 110 and the bottom wall 111 after the insulative member 14 being mounted to the insulative housing 11 along the back-to-front direction. The base portion 131 of the latch 13 is received into the mounting slot 143 of the insulative member 14, and the projected portion 144 is pressed against a rear side of the base portion 131. The rear mating portions 122 of the contacts 12 extend through the insulative member 140 by passing the through holes 142, respectively.

The metal shell 15 has a closed circumference that has a good seal performance, a good anti-EMI performance, etc. The closed circumference of the metal shell 15 could be manufactured by stamping a metal piece, bending a metal piece, die casting, etc. The metal shell 15 comprises a front end 151 to insert into a mating connector, a rear end 152, and a first transition portion 153 connecting therebetween. A circumferential dimension of the front end 151 is smaller than a circumferential dimension of the rear end 152. The rear end 152 comprises a pair of latch tabs 1520 projecting outwardly.

One of the grounding members 16 is mounted on the top wall 110, and the other one is mounted on the bottom wall 111. Each of the grounding members 16 comprises a flat body portion 160, a pair of mounting portions 161 extending from two opposite ends of the flat body portion 160 and toward the insulative housing 11 to be attached on the insulative housing 11, and a plurality of grounding tabs 162 extending forwardly from a front side of the flat body portion 160 and entering into the front portion 1132 of the receiving space 113. The mounting portions 161 and the grounding tabs 162 are received in the mounting slots 114 to mate with a receptacle connector. The grounding tabs 162 are used for mating with the metal shell 15. A distance along the vertical direction between the grounding tabs 162 of the pair of grounding members 16 is greater than a distance along the vertical direction of the front mating portions 121 of the two rows of contacts 12.

Figure 4:
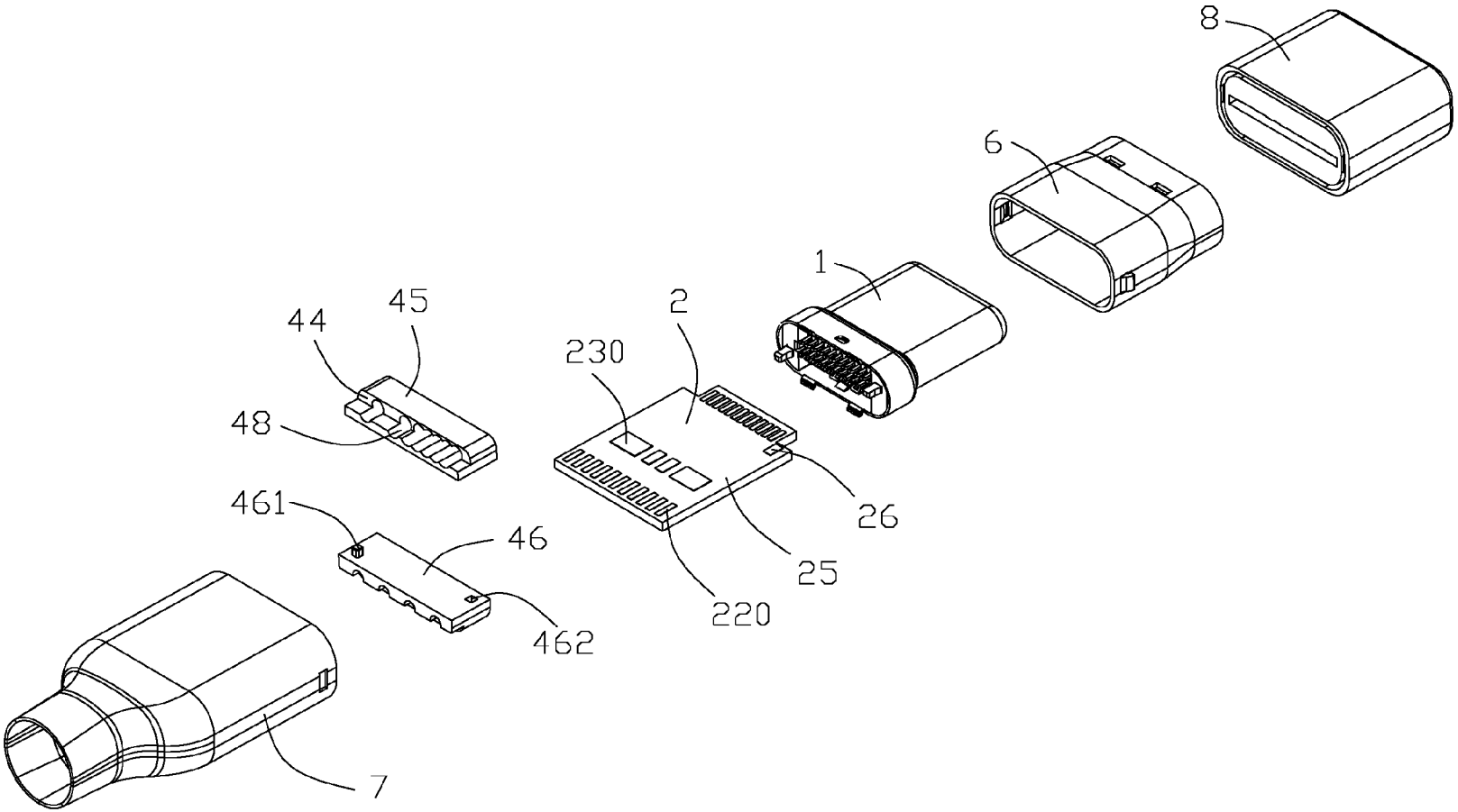
FIG. 4 is a rear upward view of the cable connector of FIG. 3.

Referring to FIGS. 2 to 4, the PCB 2 is connected between the connector 1 and the cable 300. The cable 300 is electrically connected with the contacts 12 by the PCB 2. The PCB 2 comprises a front end portion 21, a rear end portion 22, and a middle portion 23 connecting therebetween. The PCB 2 comprises an upper surface 24 and an opposite lower surface 25. A plurality of front conductive pads 210 are exposed on the upper and the lower surface of the front end portion 21 to connect with the rear mating portions 122 of the contacts 12, respectively. A plurality of rear conductive pads 220 exposed of the upper and the lower surface of the rear end portion 22 to connect with the cable 300. A plurality of middle conductive pads 230 exposed on the lower surface of the middle portion 23. The width of the front end portion 21 is smaller than the width of the rear end portion 22 along the transverse direction. A pair of soldering pads 26 are exposed on the upper and the lower surface of the middle portion 23, respectively, to solder with corresponding connecting tails 134. The pitch between the adjacent front conductive pads 210 is smaller than the pitch between the adjacent rear conductive pads 220. The size of the rear conductive pad 220 is larger than the size of the front conductive pad 210, and the number of the front conductive pad 210 is larger than the number of the rear conductive pads 220. The front portion 21 of the PCB 2 is mounted between the rear mating portions 122 of the two rows of contacts 12. The rear mating portions 122 of the contacts 12 are electrically and physically connected with the corresponding front conductive pads 210.

In this embodiment, the spacer 4 includes an upper half 41 and a lower half 42 mounted thereto for limiting conductive wires of the cable 300. The spacer 4 also can be made in one piece in another embodiment. Each of the upper half 41 and the lower half 42 includes a front wall 43 neighbored to the PCB 2, an opposite rear wall 44, and an upper wall 45 and a lower wall 46 connecting the front wall 43 and the rear wall 44. A plurality of positioning holes 47 extend through the front wall 43 and the rear wall 44 along the front-to-back direction. A plurality of limiting slots 48 are formed on the rear end of the spacer 4 to receive the conductive wires of the cable 300. A pair of mounting posts 461 project from corresponding lower wall 46. A pair of mounting holes 462 recess from corresponding lower wall 46 to receive the mounting posts 461.

The metal cage 5 includes a front cage 6 and a rear cage 7 assembled thereto. The front cage 6 has a closed circumference that has a good seal performance, a good anti-EMI performance, etc. The closed circumference of the front cage 6 could be manufactured by stamping a metal piece, bending and forming a metal piece, die casting, etc. The front cage 6 includes a front section 61, a rear section 62 opposite to the front section 61, and a second transition portion 63 connected therebetween. The circumferential dimension of the front section 61 is smaller than the circumferential dimension of the rear section 62. The front section 61 defines a pair of latch holes 611 latched with the latch tabs 1520 of the metal shell 15, when the rear cage 7 is mounted on an outer side of the rear end 152 of the metal shell 15. The front section 61 of the front cage 6 is interference fit with the rear end 152 of the metal shell 15. The front section 61 of front cage 6 and the rear end 152 of the metal shell 15 are further connected by laser welding in some spots or full circumference to have a good strength. The rear section 62 is telescoped on an outer side of the spacer 4. The inner member 8 is an insulative member which is over molded on the front section 61.

The rear cage 7 has a closed circumference that has a good seal performance, a good anti-EMI performance, etc. The closed circumference of the rear cage 7 could be manufactured by stamping a metal piece, bending and forming a metal piece, die casting, etc. The rear cage 7 comprises a main portion 71 telescoped with the rear section 62 of the front cage 6, a ring portion 72 telescoped and crimped with the cable 300, and a third transition portion 73 between the main portion 71 and the ring portion 72. The diametrical dimension of the main portion 71 is larger than the diametrical dimension of the ring portion 72. In assembling, firstly, the rear cage 7 is telescoped on the cable 300. The rear cage 7 is moved forwardly and telescoped on the spacer 4. Then, the rear cage 7 is forwardly moved beyond the spacer 4 to latch with the front cage 6. The main portion 71 of rear cage 7 and the rear section 62 of the front cage 6 are further connected by spot laser welding to have a good strength.

The outer housing 9 includes a middle portion 91 enclosing the front cage 6 and the inner member 8 therein, a rear portion 92 enclosing a rear end of the rear cage 7, and a front portion 93 extending forwardly from the body portion 91 beyond the front cage 6. The front portion 93 defines a receiving cavity to receive a rear part of the front end 151 of the metal shell 15. The front end 15 extends forwardly out of the front portion 93. The front portion 93 prevents the cable connector assembly from mistakenly inserting into an unintended receptacle connector. The outer housing 9 includes a top wall 94, a bottom wall 95, and a pair of side walls 96 connected therebetween. The front portion 93 extends forwardly from the top wall 94, the bottom wall 95, and side walls 96. Each of the side walls 96 and the bottom wall 95 defines a mating slot/cutout 931 recessed backwardly from a front end of the front portion 93 to mate with a mating receptacle connector. The front portion 93 defines some cutouts 931 either along a center line of a vertical center plane or a center line of a horizontal center plane thereof. Each of the side walls defines a positioning hole 97 recessed inwardly to mate with a positioning post of a mating connector to enhance retention force of the cable connector assembly and the mating connector. There is an angle between the cable 300 and the outer housing 9 so as to leave more space for wires of the cable 300. The mating connector has a mating structure to fit with the front portion 93 of the cable connector assembly 100, so the cable connector assembly 100 can mate with the mating connector. When the cable connector assembly 100 is inserted into the unintended receptacle connector (or a stand USB type-C receptacle connector), the front portion 93 of the outer housing 9 will block a further insertion of cable connector assembly 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a connector including a metal shell having a front end for inserting into a mating connector and a rear end, a circumferential dimension of the front end being smaller than a circumferential dimension of the rear end;

a metal cage enclosing the rear end of the metal shell and defining a receiving chamber;

an outer housing enclosing the metal cage therein; and a cable including a front part received within the receiving chamber and electrically connected to the connector;

wherein the outer housing includes a front portion extending forwardly beyond the metal cage to avoid mistakenly inserting into an unintended receptacle connector.

2. The cable connector assembly as claimed in claim 1, wherein the outer housing includes a top wall, a bottom wall, and a pair of side walls connected therebetween, the front portion extending forwardly from the top wall, the bottom wall, and the side walls.

3. The cable connector assembly as claimed in claim 2, wherein the front portion defines a receiving cavity to receive a rear part of the connector.

4. The cable connector assembly as claimed in claim 2, wherein the front portion defines a mating slot recessed backwardly to mate with the mating connector.

5. The cable connector assembly as claimed in claim 4, wherein each of the side walls has one said mating slot.

6. The cable connector assembly as recited in claim 4, wherein the bottom wall has one said mating slot.

7. The cable connector assembly as recited in claim 2, wherein the outer housing defines a positioning hole for enhance retention force to the mating connector.

8. The cable connector assembly as recited in claim 7, wherein each of the side walls has one said positioning hole.

9. The cable connector assembly as recited in claim 1, wherein an axis of the cable crosses over an axis of the outer housing.

10. The cable connector assembly as recited in claim 1, further comprising an inner member over molded on a front section of the metal cage, the front portion of the outer housing extending forwardly beyond the inner member.

11. The cable connector assembly as recited in claim 1, further comprising a printed circuit board (PCB) connected between the connector and the cable, the PCB received in the receiving room of the metal cage.

12. The cable connector assembly as recited in claim 11, wherein the metal cage includes a front cage assembled to the metal shell and a rear cage assembled to the front cage.

13. A cable connector assembly comprising:

a connector including a metal shell having a front end for inserting into a mating connector and a rear end, a circumferential dimension of the front end being smaller than a circumferential dimension of the rear end;

a metal cage connected to the rear end of the metal shell;

an outer housing enclosing the metal cage therein; and a cable including a front section enclosed within the metal cage and located behind and electrically connected to the connector and ; wherein the outer housing includes a front portion extending forwardly beyond the metal cage and surrounding a rear portion of the metal shell.

14. The cable connector assembly as claimed in claim 13, wherein the front portion is circumferentially spaced from the rear portion of the metal shell.

15. The cable connector assembly as claimed in claim 14, wherein said front portion defines some cutouts either along a center line of a vertical center plane or a center line of a horizontal center plane thereof.

16. The cable connector assembly as claimed in claim 3, wherein the rear part is circumferentially spaced from the front portion of the outer housing and a front part extends forwardly out of the front portion.

17. The cable connector assembly as claimed in claim 13, wherein the rear end of the metal shell is received in the receiving cavity, and the front end of the metal shell extends forwardly out of the front portion.

* * * * *